United States Patent [19]

Keevert, Jr. et al.

[11] Patent Number: 4,945,035

[45] **Date of Patent: * Jul. 31, 1990**

[54] PHOTOGRAPHIC EMULSIONS CONTAINING INTERNALLY MODIFIED SILVER HALIDE GRAINS

[75] Inventors: John E. Keevert, Jr.; Woodrow G. McDugle; Raymond S. Eachus, all of Rochester, N.Y.

[73] Assignee: Eastman Kodak Company, Rochester, N.Y.

[ * ] Notice: The portion of the term of this patent subsequent to May 20, 2006 has been disclaimed.

[21] Appl. No.: 179,377

[22] Filed: Apr. 8, 1988

[51] Int. Cl.[5] ..... G03C 1/06

[52] U.S. Cl. ..... 430/567; 430/569; 430/596; 430/604; 430/605; 430/606; 430/612

[58] Field of Search ..... 430/567, 569, 604, 605, 430/606, 612, 596

[56] References Cited

U.S. PATENT DOCUMENTS

| | | | |
|---|---|---|---|
| 2,448,060 | 8/1948 | Trivelli et al. | 430/603 |
| 3,790,390 | 2/1974 | Shiba et al. | 430/567 |
| 3,890,154 | 6/1975 | Ohkubo | 430/434 |
| 4,126,472 | 11/1978 | Sakai et al. | 430/264 |
| 4,147,542 | 4/1979 | Habu | 430/346 |
| 4,643,965 | 2/1987 | Kubot et al. | 430/567 |
| 4,835,093 | 5/1989 | Janusonig et al. | 430/567 |

FOREIGN PATENT DOCUMENTS

| | | | |
|---|---|---|---|
| 0242190/A2 | 10/1987 | European Pat. Off. . | |
| 62-212641 | 9/1987 | Japan | 430/605 |

OTHER PUBLICATIONS

*Research Disclosure,* vol. 176, Dec. 1978, Item 17643, Section IA.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978.

At the 1982 International Congress of Photographic Science at the University of Cambridge, R. S. Eachus presented a paper titled, "The Mechanism of $Ir^{3+}$ Sensitization of Silver Halide Materials".

B. H. Carroll, "Iridium Sensitization: A Literature Review", *Photographic Science and Engineering,* vol. 24, No. 6, Nov./Dec. 1980, pp. 265–267, is cited for further background on the use of iridium is silver halide emulsions.

*Primary Examiner*—Roland E. Martin
*Assistant Examiner*—Janet C. Baxter
*Attorney, Agent, or Firm*—Carl O. Thomas

[57] ABSTRACT

Photographic silver halide emulsions are disclosed comprised of radiation sensitive silver halide grains containing greater than 50 mole percent chloride and less than 5 mole percent iodide, based on total silver, with any residual halide being bromide, said grains exhibiting a face centered cubic crystal lattice structure formed in the presence of a hexacoordination complex of rhenium, ruthenium, or osmium with at least four cyanide ligands. The emulsions exhibit increased sensitivity.

14 Claims, 1 Drawing Sheet

PHOTOGRAPHIC EMULSIONS CONTAINING INTERNALLY MODIFIED SILVER HALIDE GRAINS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "high chloride emulsion" refers to a silver halide emulsion which contains greater than 50 mole percent chloride and less than 5 mole percent iodide, based on total silver, with any remaining halide being bromide.

The term "dopant" refers to a material other than a silver or halide ion contained within a silver halide grain.

The term "transition metal" refers to any element of groups 3 to 12 inclusive of the periodic table of elements.

The term "heavy transition metal" refers to transition metals of periods 5 and 6 of the periodic table of elements.

The term "light transition metal" refers to transition metals of period 4 of the periodic table of elements.

The term "palladium triad transition metals" refers to period 5 elements in groups 8 to 10 inclusive—i.e., ruthenium, rhodium, and palladium.

The term "platinum triad transition metals" refers to period 6 elements in groups 8 to 10 inclusive—i.e., osmium, iridium, and platinum.

The acronym "EPR" refers to electron paramagnetic resonance.

The acronym "ESR" refers to electron spin resonance.

The term "$pK_{sp}$" indicates the negative logarithm of the ty product constant of a compound.

Grain sizes, unless otherwise indicated, are mean effective circular diameters of the grains, where the effective circular diameter is the diameter of a circle having an area equal to the projected area of the grain.

Photographic speeds are reported as relative speeds, except as otherwise indicated.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound of a palladium or platinum triad transition metal, identified by the general formula:

$$R_2MX_6$$

wherein

R represents a hydrogen atom, an alkali metal atom, or an ammonium radical,

M represents a palladium or platinum triad transition metal, and

X represents a halogen atom—e.g., a chlorine or bromine atom.

The formula compounds are hexacoordinated heavy transition metal complexes which are water soluble. When dissolved in water $R_2$ dissociates as two cations while the transition metal and halogen ligands disperse as a hexacoordinated anionic complex.

With further investigation the art has recognized a distinct difference in the photographic effect of transition metal compounds in silver halide emulsions, depending upon whether the compound is introduced into the emulsion during precipitation of silver halide grains or subsequently in the emulsion making process. In the former instance it has been generally accepted that the transition metal can enter the silver halide grain as a dopant and therefore be effective to modify photographic properties, though present in very small concentrations. Then transition metal compounds are introduced into an emulsion after silver halide grain precipitation is complete, the transition metals can be absorbed to the grain surfaces, but are sometimes largely precluded from grain contact by peptizer interactions. Orders of magnitude higher concentrations of transition metals are required to show threshold photographic effects when added following silver halide grain formation as compared to transition metals incorporated in silver halide grains as dopants. The art distinction between metal doping, resulting from transition metal compound addition during silver halide grain formation, and transition metal sensitizers, resulting from transition metal compound addition following silver halide grain formation, is illustrated by *Research Disclosure*. Vol. 176, December 1978, Item 17643, wherein Section IA, dealing with metal sensitizers introduced during grain precipitation, and Section IIIA, dealing with metal sensitizers introduced during chemical sensitization, provide entirely different lists of prior art teachings relevant to each practice. *Research Disclosure* is published by Kenneth Mason Publications, Ltd., Emsworth, Hampshire P010 7DD, England.

Since transition metal dopants can be detected in exceedingly small concentrations in silver halide grains and since usually the remaining elements in the transition metal compounds introduced during grain precipitation are much less susceptible to detection (e.g., halide or aquo ligands or halide ions), grain analysis has focused on locating and quantifying the transition metal dopant concentration in the grain structure. While Trivelli and Smith taught to employ only anionic hexacoordinated halide complexes of transition metals, many if not most listings of transition metal compounds to be introduced during silver alide grain formation have indiscriminately lumped together simple salts of transition metals and transition metal complexes. This is evidence that the possibility of ligand inclusion in grain formation or any modification in peformance attributable thereto was overloaded.

In fact, a survey of the photographic literature identifies very few teachings of adding to silver halide emulsions during grain formation compounds of transition metals in which &he transition metal is other than a palladium and platinum triad transition metal and the remainder of the compound is provided by other than halide ligands, halide and aquo ligands, halides which dissociate to form anions in solution, or ammonium or alkali metal moieties that dissociate to form cations in solution. The following is a listing of the few variant teachings that have been identified:

Shiba et al U.S. Pat. No. 3,790,390 discloses preparing a blue responsive silver halide emulsion suitable for flash exposure which can be handled under bright yellowish-green light. The emulsion contains grains with a mean size no larger than 0.9 μm, at least one group 8 10 metal compound, and a formula specified merocyanine dye. Examples of transition metal compounds are simple salts of light transition metals, such as iron, cobalt, and nickel salts, and hexacoordinated complexes of light transition metals containing cyano ligands. Significantly, there is no teaching or suggestion of employing cyano ligands with heavy transition metals. Heavy transition metal compounds are disclosed only as the usual simple salts or hexacoordinated complexes containing only halide ligands. Palladium (II) nitrate, a simple salt, is also disclosed as well as palladium tetrathiocyanatopalladate (II), a tetracoordinated complex of palladium.

Ohkubo et al U.S. Pat. No. 3,890,154 and Habu et al U.S. Pat. No. 4,147,542 are similar to Shiba et al, differing principally in employing different sensitizing dyes to allow recording of green flash exposures.

Sakai et al U.S. Pat. No. 4,126,472 discloses producing a high contrast emulsion suitable for lith photography by ripening an emulsion containing at least 60 mole percent silver chloride in the presence of $10^{-6}$ to $10^{-4}$ mole per mole of silver halide of a water soluble iridium salt and further adding a hydroxytetraazaindene and a polyoxyethylene compound. In addition to the usual iridium halide salts and hexacoordinated iridium complexes containing halide ligands Sakai et al discloses cationic hexacoordinated complexes of iridium containing amine ligands. Since iridium is introduced after silver halide precipitation is terminated, the iridium is not employed as a grain dopant, but as a grain surface modifier. This undoubtedly accounts for the variance from conventional iridium compounds used for doping.

D.M. Samoilovich, "The Influence of Rhodium and Other polyvalent Ions on the photographic properties of Silver Halide Emulsions", in a paper presented to 1978 International Congress of photographic Science, Rochester Institute of Technology, Aug 20–26, 1978, reported investigations of chloride iridium, rhodium, and gold complexes and, in addition, an emulsion prepared by introducing $(NH_4)_6Mo_7O_{24}4H_2O$. The latter dissociates in water form a molybdenum cluster having a net negative charge of −6. Neither the +6 oxidation state ascribed to molybdenum nor the −6 valence of the anionic cluster should be confused with a hexacoordinated complex of a single transition metal atom.

At the 1982 International Congress of photographic Science at the University of Cambridge, R. S. Eachus presented a paper titled, "The Mechanism of $If^3$ +Sensitization of Silver Halide Materials", wherein inferential electron paramagnetic resonance (EPR) spectroscopic evidence was presented that $Ir^{3+}$ *ions were incorporated into melt grown silver bromide and silver chloride crystals as* $(IrBr_6)^{-3}$ and $(IrCl_6)^{-3}$. In emulsions and sols of these salts, the hexabromoiridate and hexachloroiridate molecular ions, as well as similar complexes containing mixed halides, were introduced during precipitation. The aquated species $[IrCl_4(H_2O)_2]^{-1}$ and $[IrCl_5(H_2O)]^{-2}$ were also successfully doped into precipitates of both silver salts. Eachus went on to speculate on various mechanisms by which incorporated iridium ions might contribute to photogenerated free electron and hole management, including latent image formation. B. H. Carroll, "Iridium Sensitization: A Literature Review", *Photographic Science and Engineering,* Vol. 24, No. 6, Nov./Dec. 1980, pp. 265–267, is cited for further background.

Greskowiak Published European Patent Application No. 0,242,90/ A2 discloses reductions in high intensity reciprocity failure in silver halide emulsions formed in the presence of one or more complex compounds of rhodium (III) having 3, 4, 5, or 6 cyanide ligands attached to each rhodium ion.

RELATED PATENT APPLICATIONS

McDugle et al U.S. Ser. No. 179,376 filed concurrently herewith and commonly assigned, titled PHOTOGRAPHIC EMULSIONS CONTAINING INTERNALLY MODIFIED SILVER HALIDE GRAINS, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

Marchetti et al U.S. Ser. No. 179,378, concurrently filed and commonly assigned, titled PHOTOGRAPHIC EMULSIONS CONTAINING INTERNALLY MODIFIED SILVER HALIDE GRAINS, discloses photographic emulsions comprised of radiation sensitive silver bromide or bromoiodide grains which exhibit a face centered cubic crystal structure formed in the presence of a hexacoordination complex of rhenium, ruthenium, or osmium with at least four cyanide ligands.

Janusonis et al, U.S. Ser. No. 179,380, concurrently filed and commonly assigned, titled INTERNALLY DOPED SILVER HALIDE EMULSIONS, now U.S. Pat. No. 4,835,093 discloses photographic emulsions comprised of silver halide grains exhibiting a face centered cubic crystal lattice structure and internally containing rhenium.

SUMMARY OF THE INVENTION

In one aspect this invention is directed to a photographic silver halide emulsion comprised of radiation sensitive silver halide grains containing greater than 50 mole percent chloride and less than 5 mole percent iodide, based on total silver, with any residual halide being bromide, said grains exhibiting a face centered cubic crystal lattice structure formed in the presence of a hexacoordination complex of rhenium, ruthenium, or osmium with at least four cyanide ligands.

Surprisingly, increased sensitivities are produced in high chloride emulsions formed in the presence of these rhenium, ruthenium, and osmium coordination complexes. Whereas, when another transition metal is substituted, either no sensitization or desensitization has been observed. Additionally, when rhenium, ruthenium, or osmium coordination complexes containing ligands other than the required cyanide ligands, the photographic effect is not observed.

DESCRIPTION OF PREFERRED EMBODIMENTS

Figure 1:
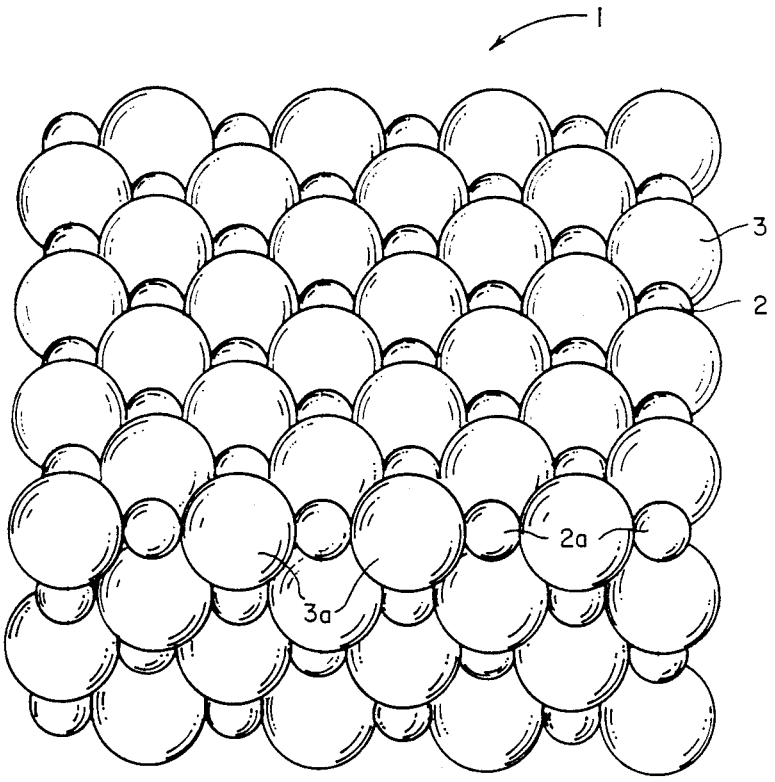
FIG. 1 is a schematic view of a silver bromide crystal structure with the upper layer of ions lying along a {100} crystallographic face.

The present invention is directed to high chloride emulsions which exhibit increased sensitivity. Such emulsions contain greater than 50 mole percent (preferably greater than 70 mole percent and optimally greater than 85 mole percent) chloride. The emulsions contain less than 5 mole percent iodide (preferably less than 2 mole percent) iodide, with the balance, if any, of the halide being iodide.

It has been discovered quite unexpectedly that the sensitivity of these emulsions can be increased when the grains of the emulsion are formed in the presence of a hexacoordination complex of rhenium, ruthenium, or osmium with at least four cyanide ligands. Surprisingly, sensitization has not been observed when other &transition metals (more specifically identified in the examples below) have been substituted for rhenium, ruthenium, or osmium. Further, it has been observed that sensitization is not achieved when the cyanide ligands are replaced with other ligands. This latter observation suggests that both the transition metal and cyanide ligands are incorporated in the grains as they are being formed.

It is in fact believed that the entire hexacoordinated transition metal complex is incorporated intact in &he grains being formed. To understand how this can be possible, it is helpful to first review the structure of silver halide grains. Unlike silver iodide, which commonly forms only $\beta$ and $\gamma$ phases and is rarely used in photography, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of atoms shown counting from the bottom of FIG. 1 lie in a {100} crystallographic plane which perpendicularly intersects the [100) crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The arrangement of atoms in a silver chloride crystal is the same as that shown in FIG. 1, except that chloride ions are smaller than bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are 1larger than the bromide ions.

The manner in which a hexacoordinated transition metal complex can be incorporated in the grain structure can be roughly appreciated by considering the characteristics of a single silver ion and six adjacent halide ions (hereinafter collectively referred to as the seven vacancy ions) that must be omitted from the crystal structure to accommodate spatially the hexacoordinated transition metal complex. The seven vacancy ions exhibit a net charge of $-5$. This suggests that anionic transition metal complexes should be more readily incorporated in the crystal structure than neutral or cationic transition metal complexes. This also suggests that the capability of a hexacoordinated heavy transition metal complex to trap either photogenerated holes or electrons may be determined to a significant degree by whether the complex introduced has a net charge more or less negative than the seven vacancy ions it displaces. This is an important departure from the common view that heavy transition metals are incorporated into silver halide grains as bare ions or atoms and that their hole or electron trapping capability is entirely a function of their oxidation state.

Referring to FIG. 1, it should be further noted that& the silver ions are much smaller than the bromide ions, though silver lies in the 5th period while bromine lies in the 4th period. Further, the lattice is known to accommodate iodide ions, which are still larger than bromide ions. This suggests that the size of 5th and 6th period transition metals should not in itself provide any barrier to their incorporation. A final observation that can be drawn from the seven vacancy ions is that the six halide ions exhibit an ionic attraction not only to the single silver ion that forms the center of the vacancy ion group, but are also attracted to other adjacent silver ions.

Hexacoordinated complexes exhibit a spatial configuration that is compatible with the face centered cubic crystal structure of photographically useful silver halides. The six ligands are spatially comparable to the six halide ions next adjacent to a silver ion in the crystal structure. To appreciate that a hexacoordinated complex of a heavy transition metal having ligands other than halide ligands or, as recognized by Eachus, cited above, aquo ligands, can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a hexacoordinated complex can be spatially accommodated into a silver halide crystal structure in &he space that would otherwise be occupied by the seven vacancy ions, even though the number and/or diameters of the individual atoms forming the complex exceeds that of the vacancy ions. This is because the covalent bond strength can significantly reduce bond distances and therefore the size of the entire complex. It is a specific recognition of this invention that multielement ligands of hexacoordinated transition metal complexes can be spatially accommodated to single halide ion vacancies within the crystal structure.

While spatial compatibility is important in choosing suitable hexacoordinated transition metal complexes, another factor which must be taken into account is the compatibility of the complex with the next adjacent ions in the crystal lattice structure. It is the recognition of this invention that compatibility can be realized by choosing bridging ligands for the transition metal complex. Looking at a single row of silver and halide ions in a cubic crystal lattice structure, the following relationship can be observed:

$$Ag^+X^-Ag^+X^-Ag^+X^-Ag^+X^-, \text{etc.}$$

Notice that the halide ions X are attracting both adjacent silver ions in the row. When the portion of a hexacoordinated transition metal complex lying in a single row of silver and halide ions in a crystal structure is considered, the following relationship can be observed:

$$Ag^+X^-Ag^+—L—M—L—Ag^+X^-, \text{etc.}$$

where

M represents a heavy transition metal and

L represents a bridging ligand.

While only one row of silver and halide ions is shown, it is appreciated that the complex forms part of three identical perpendicular rows of silver and halide ions having the heavy transition metal M as their point of intersection. However, since the three rows are identical, the relationships can be appreciated from considering a single row.

Transition metal coordination complexes satisfying the requirements of this invention are those which contain rhenium. ruthenium, or osmium as a transition metal and 4, 5, or 6 cyanide ligands. When only 4 or 5 cyanide ligands are present, the remaining ligands or ligand can be any convenient conventional bridging ligand. The latter when incorporated in the silver halide crystal structure are capable of serving as bridging groups between two or more metal centers. These bridging ligands can be either monodentate or ambidentate. A monodentate bridging ligand has only one ligand atom that forms two (or more) bonds to two (or more) different metal atoms. For monoatomic ligands and for those con&aining only one donor atom, only the monodentate form of bridging is possible. Multielement ligands with more than one donor atom can also function in a bridging capacity and are referred to as ambidentate ligands. Preferred bridging ligands are monoatomic monodentate ligands, such as halides. Fluoride, chloride, bromide, and iodide ligands are all specifically contemplated. Multielement ligands, such as azide and thiocyanate ligands, are also specifically contemplated.

The hexacoordinated rhenium, ruthenium, and osmium cyanide complexes contemplated for grain incorporation in most instances exhibit a net ionic charge. One or more counter ions are therefore usually associated with the complex to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

In a preferred form the hexacoordinated rhenium, ruthenium, and osmium cyanide complexes can be represented by the following formula:

$$[M(CN)_{6-y}L_y]^n \quad (I)$$

where

M is rhenium, ruthenium, or osmium,

L is a bridging ligand, y is the integer zero, 1, or, 2, and $-n$ is $-2$, $-3$, or $-4$ Table I provides a listing of illustrative rhenium, ruthenium, and osmium cyanide coordination complexes satisfying the requirements of the invention:

TABLE I

| | |
|---|---|
| TMC-1 | $[Re(CN)_6]^{-4}$ |
| TMC-2 | $[Ru(CN)_6]^{-4}$ |
| TMC-3 | $[Os(CN)_6]^{-4}$ |
| TMC-4 | $[ReF(CN)_5]^{-4}$ |
| TMC-5 | $[RuF(CN)_5]^{-4}$ |
| TMC-6 | $[OsF(CN)_5]^{-4}$ |
| TMC-7 | $[ReCl(CN)_5]^{-4}$ |
| TMC-8 | $[RuCl(CN)_5]^{-4}$ |
| TMC-9 | $[OsCl(CN)_5]^{-4}$ |
| TMC-10 | $[ReBr(CN)_5]^{-4}$ |
| TMC-11 | $[RuBr(CN)_5]^{-4}$ |
| TMC-12 | $[OsBr(CN)_5]^{-4}$ |
| TMC-13 | $[ReI(CN)_5]^{-4}$ |
| TMC-14 | $[RuI(CN)_5]^{-4}$ |
| TMC-15 | $[OsI(CN)_5]^{-4}$ |
| TMC-16 | $[ReF_2(CN)_4]^{-4}$ |
| TMC-17 | $[RuF_2(CN)_4]^{-4}$ |
| TMC-18 | $[OsF_2(CN)_4]^{-4}$ |
| TMC-19 | $[ReCl_2(CN)_4]^{-4}$ |
| TMC-20 | $[RuCl_2(CN)_4]^{-4}$ |
| TMC-21 | $[OsCl_2(CN)_4]^{-4}$ |
| TMC-22 | $[RuBr_2(CN)_4]^{-4}$ |
| TMC-23 | $[OsBr_2(CN)_4]^{-4}$ |
| TMC-24 | $[ReBr_2(CN)_4]^{-4}$ |
| TMC-25 | $[RuI_2(CN)_4]^{-4}$ |
| TMC-26 | $[OsI_2(CN)_4]^{-4}$ |
| TMC-27 | $[Ru(CN)_5(OCN)]^{-4}$ |
| TMC-28 | $[Os(CN)_5(OCN)]^{-4}$ |
| TMC-29 | $[Ru(CN)_5(SCN)]^{-4}$ |
| TMC-30 | $[Os(CN)_5(SCN)]^{-4}$ |
| TMC-31 | $[Ru(CN)_5(N_3)]^{-4}$ |
| TMC-32 | $[Os(CN)_5(N_3)]^{-4}$ |
| TMC-33 | $[Ru(CN)_5(H_2O)]^{-3}$ |
| TMC-34 | $[Os(CN)_5(H_2O)]^{-3}$ |

Procedures for beginning with the compounds of Table I and preparing photographic silver halide emulsions benefitted by incorporation of the hexacoordinated rhenium, ruthenium, or osmium cyanide complex can be readily appreciated by considering the prior teachings of the art relating to introducing heavy transition metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,418,122; Bacon U.S. Pat. No. 3,531,291; Bacon U.S. Pat. No. 3,574,625; Japanese Patent (Kokoku) No. 33781/74 (Priority 10 May 1968); Japanese Patent (Kokoku) No. 30483/73 (priority 2 Nov. 1968); Ohkubo et al U.S. Pat. No. 3,890,154; Spence et al U.S. Pat. Nos. 3,687,676 and 3,690,891; Gilman et al U.S. Pat. No. 3,979,213; Motter U.S. Pat. No. 3,703,584; Japanese Patent (Kokoku) No. 32738/70 (priority 22 Oct. 1970); Shiba et al U.S. Pat. No. 3,790,390; Yamasue et al U.S. Pat. No. 3,,901,713; Nishina et al U.S. Pat. No. 3,847,621; *Research Disclosure,* Vol. 108, Apr. 1973, Item 10801; Sakai U.S. Pat. No. 4,126,472; Dostes et al Defensive Publication No. T962,004 and French Patent No. 2,296,204; U.K. Specification No. 1,527,435 (priority 17 Mar. 1975); Japanese Patent Publication (Kokai) No. 107,129/76 (priority 18 Mar. 1975); Habu et al U.S. Pat. Nos. 4,147,542 and 4,173,483; *Research Disclosure,* Vol. 134, June 1975, Item 13452; Japanese Patent Publication (Kokai) No. 65,432/77 (priority 26 Nov. 1975); Japanese Patent Publication (Kokai) No. 76,923/77 (priority 23 Dec. 1975); Japanese Patent Publication (Kokai) No. 88,340/77 (priority 26 Jan. 1976); Japanese Patent Publication (Kokai) No. 75,921/78 (priority 17

Dec. 1976); Okutsu et al U.S. Pat. No. 4,221,857; Japanese Patent Publication (Kokai) No. 96,024/79 (priority 11 Jan. 1978); *Research Disclosure,* Vol. 181, May 1979, Item 18155; Kanisawa et al U.S. Pat. No. 4,288,533; Japanese Patent Publication (Kokai) No. 25,727/81 (Priority 7 Aug. 1979); Japanese Patent Publication (Kokai) 51,733/81 (priority 2 Oct. 1979); Japanese Patent Publication (Kokai) No. 166,637/80 (priority 6 Dec. 1979); and Japanese Patent Publication (Kokai) No. 149,142/81 (priority 18 Apr. 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver to 16.09 for silver iodide at room temperature. For the rhenium, ruthenium, or osmium cyanide complex to coprecipitate with silver halide it must also form a high $pK_{sp}$ compound. If the $pK_{sp}$ is too low, precipitation may not occur. On the other hand, if the $pK_{sp}$ is too high, the compound may precipitate as a separate phase. Optimum $pK_{sp}$ values for silver counter ion compounds of rhen ruthenium, or osmium cyanide complexes contemplated for use in the practice of this invention are in or near the range of $pK_{sp}$ values for photographic silver halides—that is, in the range of from about 8 to 20, preferably about 9 to 17.

Apart from the incorporated hexacoordinated heavy transition metal complexes satisfying the requirements of the invention the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure.* Item 17643, cited above, the disclosure of which is here incorporated by reference. It is specifically contemplated to incorporate hexacoordinated heavy transition metal complexes satisfying the requirements of this invention in tabular grain emulsions, particularly thin (less than 0.2 $\mu$m) and/or high aspect ratio (>8:1) tabular grain emulsions, such as those disclosed in Kofron et al U.S. Pat. No. 4,439,520; Wey U.S. Pat. No. 4,399,215; Dickerson U.S. Pat. No. 4,414,304; Maskasky U.S. Pat. Nos. 4,400,463, 4,435,501, 4,643,966,and 4,713,320; and Daubendiek et al U.S. Pat. Nos. 4,672,027 and 4,693,964; the disclosures of which are here incorporated by reference.

It has been determined by imagewise exposure, bleaching of surface latent image, and then development in an internal developer, that increased internal sensitivity can be imparted to high chloride emulsions by precipitating the grains in the presence of hexacoordinated rhenium, ruthenium, or osmium cyanide complexes of the type described above. Effective concentrations of the emulsion range from about $1\times10^{-6}$ mole of complex per silver mole. The complex can be incorporated into the grains up to its solubility limit, typically about $5\times10^{-4}$ mole per silver mole. An excess of the complex over its solubility limit in the grain can be tolerated, but normally any such excess is removed from the emulsion during washing. Preferred concentrations of the complex for achieving internal sensitivity are from $10^{-5}$ to $10^{-4}$ mole per silver mole.

When increased internal sensitivity is sought, surface competition for photogenerated electrons should be avoided. Thus, these emulsions are preferably free of intentional surface chemical sensitization. Obtaining increased internal sensitivity is, however, entirely compatible with and can be enhanced by incorporating conventional hole trapping spectral sensitizing dyes in the emulsions.

It has been surprisingly discovered that when the internally sensitized emulsions are further modified by conventional surface sulfur and/or gold sensitization—i.e., whether the sulfur or gold sensitization is the sole sensitizer or employed in combination with other conventional sensitizers, the emulsions exhibit increased surface sensitivity as compared to a control emulsion which is identically surface sensitized, but lacks the incorporated complex. Other conventional chalcogen sensitizers can be substituted for sulfur, if desired.

EXAMPLES

The invention can be better appreciated by reference to the following specific examples:

EXAMPLE 1

A AgCl powder was made without the use of any peptizing agent such as gelatin in which the variation made was in the presence of $K_4Os(CN)_6$ as a dopant.

The solutions were prepared as follows:

| | |
|---|---|
| Solution 1/1 | |
| Silver nitrate | 33.98 gms |
| Distilled water to total volume | 100 ml |
| Solution 2/1 | |
| Potassium chloride | 15.66 gms |
| Distilled water to total volume | 100 ml |

We have incorporated an anionic transition metal complex, $[Os(CN)_6]^{-4}$, into the AgCl lattice in the absence of gelatin by adding, in the dark, 100 ml of 2 M $AgNO_3$ (Solution 1/1) through one delivery buret and 100 ml of 2.1 M KCl (5% excess) (Solution (1)) through a second delivery buret into a common reaction vessel. The $[Os(CN)_6]^{-4}$ complex is usually added as the potassium salt. The reaction vessel initially contained 100 ml of water and was preheated to ca. 50° C. The reaction vessel was vigorously stirred during the $AgNO_3$ and KCl addition. The temperature in the reaction vessel fell a few degrees below 50° C during the reaction due to the inrush of room temperature reactants. The addition was generally complete in ca. 6 to 7 minutes. The addition rate was controlled manually with the only criteria that the KCl buret addition be equal to or slightly ahead, but by no more than 1 milliliter, of the $AgNO_3$ addition. The dopant was added both through a third pipette or through the KCl solution without any noticeable difference occurring between the two addition methods. The dopant was added in a number of individual steps during the entire precipitation when added through a separate pipette and continuously during the entire precipitation when added through the KCl delivery buret along with the KCl. The samples were washed well with water, ca. 500 ml of water for each 0.2 moles of AgCl precipitated. The samples were then washed several times with approximately 50 ml of acetone each time and the acetone decanted after each washing, filtered using a #2 qualitative paper filter, washed with diethyl ether, and then stored in open glass dishes in the dark until dry.

ESR of the $K_4Os(CN)_6$ doped AgCl sample before any light exposure does not show any paramagnetic osmium species. This is in contrast to the ESR of AgCl doped with the $[OsCl_6]^{-3}$ coordination complex, using $K_2OsCl_6$ as the dopant, which clearly shows paramagnetic centers $Os^{+3}$ centers present even without light exposure. After exposure of the $[Os(CN)_6]^{-4}$ doped AgCl powder samples to 365 nm radiation, ESR shows the presence of paramagnetic $Os^{+3}$ centers that result from hole paramagnetic $Os^{+2}$ centers.

The control AgCl powder without any $K_4Os(CN)_6$ dopant did not show any ESR spectra, under any conditions, of an osmium center of any type.

EXAMPLE 2

A AgCl powder sample was prepared as described in Example 1 except that both $K_2Ru(NO)Cl_5$ and $K_4Os(CN)_6$ were used to co-dope the same sample. ESR of this sample, after exposure to 365 nm radiation, showed that the $[Ru(NO)Cl_5]^{-2}$ centers were trapping electrons to produce $[Ru(NO)Cl_5]^{-3}$ centers and that the $[Os(CN)_6]^{-4}$ centers were trapping holes to produce $[Os(CN)_6]^{-3}$ centers. The two centers were not competing for the same electronic species, the photoproduced electron or the photoproduced hole. This is competely consistent with Example 1.

EXAMPLE 3

Emulsion

0.3 μm Undoped AgCl (Control)

At 40° C., 75 g of gelatin was added to 2 liters of water in a reaction vessel and the PH of the reaction vessel contents was adjusted to 3.0. The temperature was raised to 55° C., and the chloride ion concentration was adjusted to 0.041 molar. Concentrated aqueous silver nitrate was pumped into the vigorously stirred gelatin solution along with sufficient aqueous sodium chloride solution to maintain the quoted concentration. A third aqueous solution was introduced into the reaction vessel, starting 3 minutes after introduction of the silver nitrate solution. Precipitation was continued until 6 moles of approximately 0.3 μm silver chloride grains were formed.

After washing by the coagulation method of Yutzy and Russell U.S. Pat. No. 2,614,929, a portion of the emulsion was optimally gold sensitized, chilled, and then prepared for coating by the addition of extra gelatin and a spreading agent. Coatings on a cellulose acetate film support were exposed through a step tablet to 365 nm radiation and processed for 5 minutes in a hydroquinone-Elon ®(N methyl-p aminophenol hemisulfate) developer. After fixing and washing the coating, the photographic speed was determined at a density of 0.3 above fog.

Emulsion 2

0.3 μm $[Os(CN)_6]^{-4}$ Doped AgCl (Example)

The procedure described above in connection with Emulsion 1 was repeated, except that the third aqueous solution contained 69.5 mg $K_4Os(CN)_6$ to produce a reaction vessel concentration of $2.5\times10^{-5}$ mole of complex per silver mole. The third solution was added after 4 percent of the silver nitrate solution had been added to the reaction vessel, addition being completed when 74 percent of the silver nitrate had been added to the reaction vessel.

Neutron activation analysis confirmed that approximately 60 percent of the osmium hexacyanide complex in the reaction vessel was incorporated in the silver chloride grains. Table II shows that the presence of the hexacoordinated transition metal complex in the grains resulted in higher sensitivity at comparable levels of fog and contrast.

TABLE II

| Emulsion | Speed | Fog | Contrast |
|---|---|---|---|
| 1 | 100 | 0.06 | 4.2 |
| 2 | 180 | 0.05 | 4.0 |

Example 4

Emulsion 3

0.3 μm Undoped AgCl (Control)

The procedure described above in connection with Emulsion 1 was repeated, except that the emulsion was washed by ultrafiltration and development was accomplished in 12 minutes instead of 5 minutes.

Emulsion 4

0.3 μm $[Ru(CN)_6]^{-4}$ Doped AgCl (Example)

The procedure described above in connection with Emulsion 3 was repeated, except that the third aqueous solution contained 124 mg of $K_4Ru(CN)_6$, which amounts to $5.0\times10^{-5}$ mole per mole of silver in the reaction vessel. Addition of the third solution was completed when 70 percent of the total silver nitrate was added.

Sensitization and coating of the emulsion was similar to that of Emulsion 3. Neutron activation confirmed that approximately 85 percent of the ruthenium complex in the reaction vessel was incorporated in the grains. Table III demonstrates enhancement of speed and contrast.

TABLE III

| Emulsion | Speed | Fog | Contrast |
|---|---|---|---|
| 3 | 100 | 0.07 | 3.4 |
| 4 | 145 | 0.07 | 3.9 |

EXAMPLE 5

Emulsion 5

150 μmole $[Os(CN)_6]^{-4}$ Doped AgCl (Example)

This emulsion was prepared similarly as Emulsion 3, except that the distilled water solution contained 417 mg $K_4Os(CN)_6$, which amounts to $1.5\times10^{-4}$ mole per mole of silver.

Emulsion 6

0.2 μmole $[Os(CN)_6]^{-4}$ Doped AgCl (Control)

This emulsion was prepared similarly as Emulsion 3, except that the distilled water solution contained 0.56 mg $K_4Os(CN)_6$, which amounts to $2.0\times10^{-7}$ mole per mole of silver.

Portions of Emulsions 3, 4, 5, and 6, were given an optimal sulfur sensitization. The emulsions were then exposed and processed as previously described. The results are summarized in Table IV:

TABLE IV

| Emulsion | Speed | Fog |
|---|---|---|
| 3 | 100 | 0.09 |
| 4 | 162 | 0.14 |
| 5 | 204 | 0.12 |
| 6 | 102 | 0.11 |

Table IV shows that further improved speeds can be obtained when the $[Os(CN)_6]^{-4}$ is incorporated in a sulfur sensitized emulsion. However, incorporation of the osmium cyanide coordination complex at concentrations below 1 μmole per silver mole, illustrated by Emulsion 6, did not produce an increase in photographic speed.

COMPARATIVE EXAMPLES

Example 5 was repeated, but with $5.0\times10^{-6}$ mole per silver mole of each of the following hexacoordination complexes being substituted for the ruthenium or osmium cyanide complex:

$[Co(CN)_6]^{-3}$
$[Rh(CN)_6[^{-3}$
$[Ir(CN)_6]^{-3}$
$[Fe(CN)_6]^{-4}$

The cobalt and rhodium complexes were both observed to desensitize the emulsion while the iridium complex doped emulsion did not differ significantly in its photographic sensitivity from the undoped control emulsion. While the iron complex decreased fog as compared to the undoped control emulsion, it also reduced speed by 0.2 log E.

To determine the importance of the cyanide ligands, Example 5 was repeated, but an osmium or ruthenium coordination complex lacking a cyanide ligand was substituted. The complex formula with its concentration in micromoles per silver mole shown arenthetically was as follows:

$[Ru(NO)Cl_5]^{-2}$ (25)
$[Os(Cl)_6]^{-2}$ (50)
$[Ru(NO)Br_5]^{-2}$ (25)

In each instance the emulsion was significantly reduced in speed.

The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive silver halide grains containing greater than 50 mole percent chloride and less than 5 mole percent iodide, based on total silver, with any residual halide being bromide, said grains exhibiting a face centered cubic crystal lattice structure formed in the presence of a hexacoordination complex of rhenium, ruthenium, or osmium with at least four cyanide ligands.

2. A photographic emulsion according to claim 1 further characterized in that said silver halide grains contain greater than 70 mole percent chloride, based on total silver.

3. A photographic emulsion according to claim 1 further characterized in that said silver halide grains contain less than 2 mole percent iodide, based on total silver.

4. A photographic emulsion according to claim 1 further characterized in that said silver halide grains exhibit gold surface sensitization.

5. A photographic emulsion according to claim 1 further characterized in that said silver halide grains additionally exhibit sulfur surface sensitization.

6. A photographic emulsion according to claim 1 further characterized in that said rhenium, ruthenium, or osmium is present in said emulsion in a concentration of from $1\times10^{-6}$ to $5\times10^{-4}$ mole per silver mole.

7. A photographic emulsion according to claim 1 further characterized in that said hexacoordination complex satisfies the formula:

$$[M(CN)_{6-y}L_y]^n$$

where
M is rhenium, ruthenium, or osmium,
L is a bridging ligand,
y is the integer zero, 1, or 2. and
n is −2, −3, or −4.

8. A photographic emulsion according to claim 7 further characterized in that L is a halide ligand.

9. A photographic emulsion according to claim 7 further characterized in that y is zero and n is −4.

10. A photographic silver halide emulsion comprised of radiation sensitive silver halide grains surface sensitized with at least one of gold and sulfur, said grains containing greater than 70 mole percent chloride and less than 2 mole percent iodide, based on total silver, with any residual halide being bromide, said grains exhibiting a face centered cubic crystal lattice structure formed in the presence from $1\times10^{-6}$ to $5\times10^{-4}$ mole per silver mole of a hexacoordination complex of the formula:

$$[M(CN)_{6-y}L_y]^{-4}$$

where
M is ruthenium or osmium,
L is halide, and
y is the integer zero, 1, or 2.

11. A photographic emulsion according to claim 10 further characterized in that said hexacoordination complex is present in a concentration of from $10^{-5}$ to $10^{-4}$ mole per silver mole.

12. A photographic emulsion according to claim 10 further characterized in that said silver halide grains are sulfur and gold surface sensitized.

13. A photographic emulsion according to claim 10 further characterized in that said silver halide grains contain greater than 85 mole percent chloride, based on silver.

14. A photographic emulsion according to claim 13 further characterized in that said silver halide grains are silver chloride grains.

* * * * *